US006393889B2

(12) United States Patent
Mitsuda et al.

(10) Patent No.: US 6,393,889 B2
(45) Date of Patent: May 28, 2002

(54) COLOR CATHODE RAY TUBE AND METHOD FOR MANUFACTURING A SHADOW MASK FOR A COLOR CATHODE RAY TUBE

(75) Inventors: Katsumi Mitsuda, Hyogo; Hiroo Terada, Osaka, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/854,741

(22) Filed: May 14, 2001

Related U.S. Application Data

(62) Division of application No. 09/304,247, filed on May 3, 1999.

(30) Foreign Application Priority Data

Jan. 5, 1998 (JP) ..... 10-133008

(51) Int. Cl.[7] ..... B21D 22/26
(52) U.S. Cl. ..... 72/347; 72/350
(58) Field of Search ..... 72/347, 350

(56) References Cited

U.S. PATENT DOCUMENTS

| | | | |
|---|---|---|---|
| 4,286,189 A | 8/1981 | Koizumi et al. | |
| 4,678,963 A | 7/1987 | Fonda | |
| 5,057,737 A | 10/1991 | Hotta | |
| 5,359,259 A | 10/1994 | Reidinger et al. | |
| 6,104,132 A | 8/2000 | Nose et al. | |
| 6,218,772 B1 | 4/2001 | Shimizu et al. | |

FOREIGN PATENT DOCUMENTS

| | | | |
|---|---|---|---|
| EP | 0 165 785 | * 12/1985 | ..... 72/347 |
| FR | 2134436 | 12/1972 | |
| JP | 60-61122 | * 4/1985 | ..... 72/347 |
| JP | 61-14025 | * 1/1986 | ..... 72/350 |
| JP | 63-188429 | * 8/1988 | ..... 72/350 |
| JP | 8-287840 | 11/1996 | |
| JP | 8-298078 | 11/1996 | |

* cited by examiner

*Primary Examiner*—Lowell A. Larson
(74) *Attorney, Agent, or Firm*—Merchant & Gould PC

(57) ABSTRACT

A color cathode ray tube comprises (i) a glass bulb comprising a substantially rectangular panel, on which phosphors of a plurality of colors are arranged, a funnel that is connected to a rear side of the panel, and a neck portion formed at a rear side of the funnel, in which an in-line electron gun for emitting an electron beam is arranged; (ii) a substantially rectangular shadow mask having a plurality of apertures that are arranged in correspondence with the phosphors on the panel; and (iii) a substantially rectangular mask frame having a wall portion that supports opposing skirt portions of the shadow mask. The surface of the shadow mask with the apertures is convex towards the panel. A central portion of the opposing skirt portion is convex in a direction of the tube axis on the side of the electron gun. Processing warps such as wrinkles in the skirt portions of the shadow mask are avoided, and a color cathode ray tube with good color rendition is obtained.

1 Claim, 9 Drawing Sheets

COLOR CATHODE RAY TUBE AND METHOD FOR MANUFACTURING A SHADOW MASK FOR A COLOR CATHODE RAY TUBE

This application is a divisional of application Ser. No. 09/304,247, filed May 3, 1999, which application(s) are incorporated herein by reference.

BACKGROUND OF THE INVENTION

1. Field of the Invention

The present invention relates to a color cathode ray tube, such as is used for a color television receiver or an information processing device, and a method for manufacturing a shadow mask for a color cathode ray tube.

2. Description of the Prior Art

Conventional color cathode ray tubes comprise a glass bulb, a shadow mask, and a mask frame. The glass bulb comprises a panel on which phosphors of several colors are arranged, a funnel connected to the rear side of the panel, and a neck portion formed at the rear side of the funnel. An in-line electron gun for emitting an electron beam is arranged in the neck portion. The shadow mask has a surface with a plurality of apertures corresponding to each phosphor of the panel, which is convex towards the panel side. The mask frame has a wall portion to support a skirt portion of the shadow mask.

In order to block the earth's magnetic field, an overlapping portion A with which the skirt portion 2 of the shadow mask 1 overlaps a wall portion 4 of the mask frame 3 is made large by enlarging the length of the skirt portion 2 in the direction of the tube axis Z, as shown in FIG. 8.

However, since the length of the skirt portion 2 of the shadow mask 1 in the direction of the tube axis Z in such conventional color cathode ray tubes is large, press forming it causes warps, such as the wrinkles B in the width direction of the skirt portion 2, shown in FIG. 9. Since, after the mask frame 3, to which the skirt portions 2 of the shadow mask 1 have been welded, has been attached to the inside of the glass bulb, the temperature of the glass bulb is rapidly increased to about 400° C. in a frit-sealing step, and then decreased from about 400° C. to about 100° C. in an exhaustion step, processing warps such as the wrinkles B in the skirt portions 2 change, the position of the apertures of the shadow mask 1 that are arranged to correspond with the color phosphors on the panel shifts away from the correct position, and it becomes difficult to ensure correct color rendition because the tolerances for the beam landing positions become insufficient. These problems are even more pronounced when invar is used as the shadow mask material instead of steel.

SUMMARY OF THE INVENTION

It is an object of the present invention to solve the problems of the prior art and to provide a color cathode ray tube wherein processing warps such as wrinkles in the skirt portion of the shadow mask are avoided, and correct color rendition can be ensured. It is a further object of the present invention to provide a method for manufacturing a shadow mask for this color cathode ray tube.

A color cathode ray tube in accordance with the present invention comprises (i) a glass bulb comprising a substantially rectangular panel, whereon phosphors of a plurality of colors are arranged, a funnel that is connected to a rear side of the panel, and a neck portion formed at a rear side of the funnel, wherein an in-line electron gun for emitting an electron beam is provided; (ii) a substantially rectangular shadow mask having a plurality of apertures that are arranged in correspondence with the phosphors on the panel; and (iii) a substantially rectangular mask frame having a wall portion that supports a skirt portion of the shadow mask. The surface of the shadow mask with the apertures is convex towards the panel. A central portion of the opposing skirt portion is convex in a direction of the tube axis on the side of the electron gun.

With this configuration, processing warps in the width direction of the convex portions of the skirt portions of the shadow mask can be reduced.

In accordance with the present invention, a method for manufacturing a shadow mask for a color cathode ray tube having a panel uses a first upper die and a first lower die for forming a surface of a flat mask plate having apertures into a convex surface; and a second upper die and a second lower die for sandwiching a peripheral portion of the flat mask plate, which slidably enclose a peripheral surface of said first upper die and said first lower die. The method comprises sandwiching said flat mask plate between said first and second upper dies and said first and second lower dies; displacing said first upper and said first lower die in a vertical direction with respect to said second upper die and said second lower die, whereby the flat mask plate is drawn and a surface of the flat mask plate having apertures is formed into a convex surface towards the panel of the color cathode ray tube; releasing the pressure from said second upper die and said second lower die onto the peripheral portion of the flat mask plate; and forming a peripheral portion of the flat mask plate to be parallel to a tube axis direction of the color cathode ray tube by displacing said first upper and said first lower die even further with respect to said second upper die and said second lower die.

With this configuration, processing warps in the width direction of the skirt portions can be reduced, if for example the central portions of opposing skirt portions of the shadow mask on the side of the electron gun—corresponding to the peripheral portion of a flat mask plate—are formed into convex shapes with respect to the tube axis direction

DESCRIPTION OF THE PREFERRED EMBODIMENTS

The following is a description of the preferred embodiments, with reference to the accompanying drawings.

Figure 1:
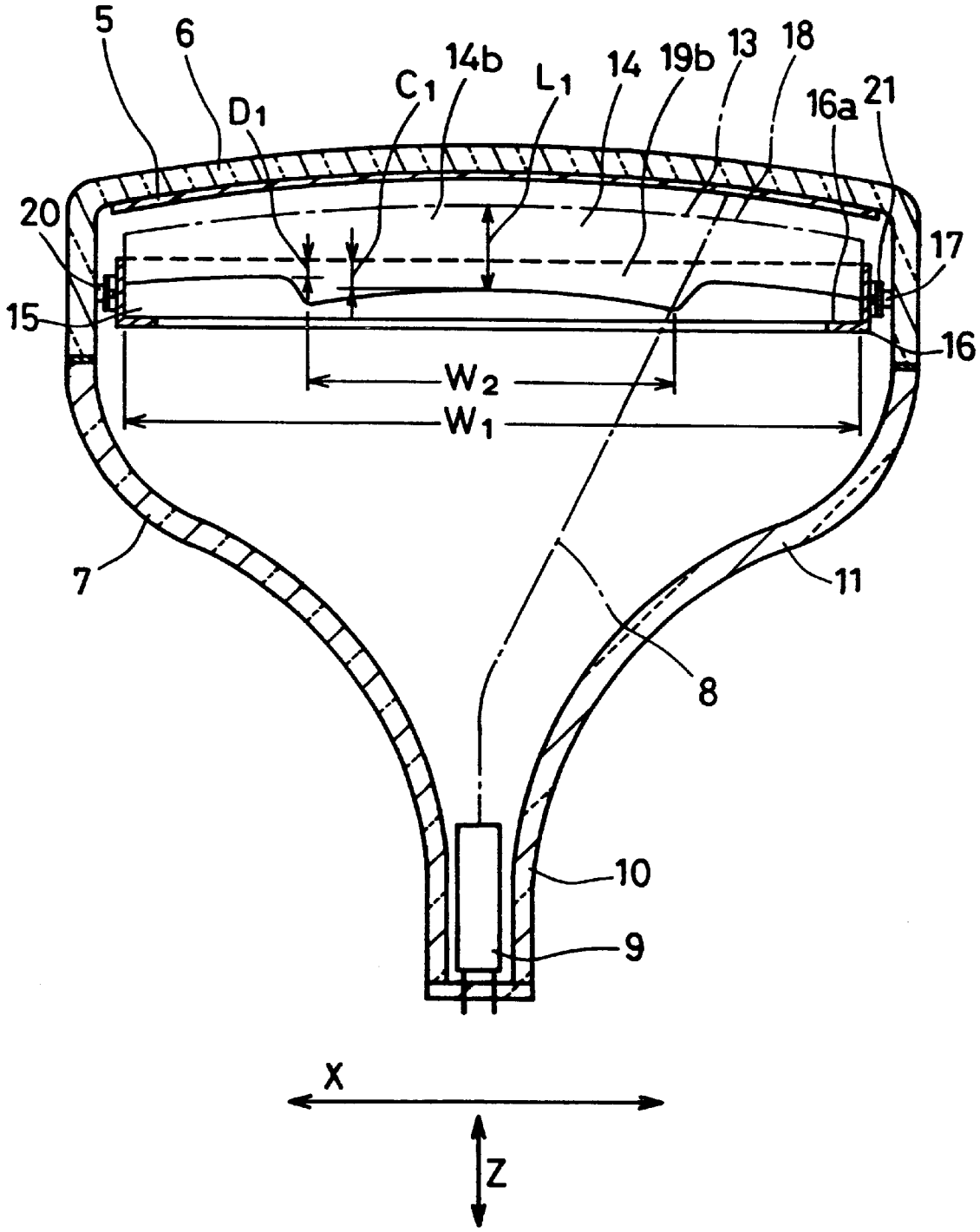
FIG. 1 is a lateral cross-section of a color cathode ray tube of the present invention.
Figure 2:
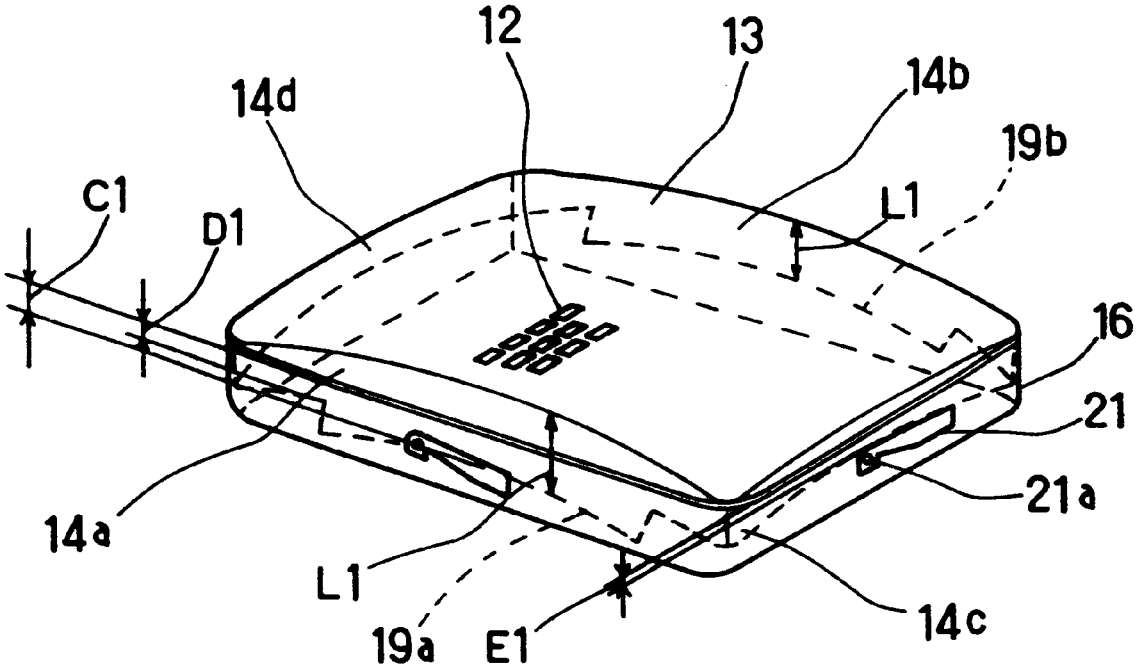
FIG. 2 is a perspective view showing the shadow mask portion of the color cathode ray tube in FIG. 1.

As is shown in FIGS. 1 and 2, a color cathode ray tube in accordance with the present invention comprises a glass bulb 11, which comprises a substantially rectangular panel 6, on whose inner surface phosphors 5 of a plurality of colors are arranged, a funnel 7 that is connected to a rear side of the panel 6, and a neck portion 10 formed at a rear side of the funnel 7. An in-line electron gun 9 for emitting an electron beam 8 is arranged inside the neck portion. The color cathode ray tube further comprises a substantially rectangular shadow mask 13 having a plurality of apertures 12 that are arranged in correspondence with the phosphors 5 on the panel 6, a substantially rectangular mask frame 16 having a wall portion 15 that supports a skirt portion 14 of the shadow mask 13, and a supporting member 17 for supporting the mask frame 16 in the glass bulb 11.

The shadow mask 13 can be made of invar for example. The surface 18 with the apertures 12 is convex towards the side of the panel 6. The central portions of the opposing skirt portions 14*a* and 14*b* on the major sides have convex portions 19*a* and 19*b* on the side facing the electron gun 9 that are more convex in the direction of the tube axis Z than peripheral portions of the skirt portions 14*a* and 14*b*.Moreover, the length L1 of the convex portions 19*a* and 19*b* of the skirt portions 14*a* and 14*b* in the direction of the tube axis (i.e. the distance between the end surface of the convex portions 19*a,* 19*b* and the curved surface of the shadow mask 13 opposing this end surface) is uniform.

The skirt portions 14*a,* 14*b,* 14*c,* and 14*d* of the shadow mask 13 are welded to the wall portion 15 of the mask frame 16, and thus supported by the mask frame 16. The minimum length of the overlapping portion C1 (measured in the direction of the tube axis) between the wall portion 15 and the convex portions 19*a* and 19*b* of the skirt portions 14*a* and 14*b* is at least 8 mm. In other words, the minimum distance between an end face of the wall portion 15 and the tip of the convex portions 19*a* and 19*b* of the skirt portions 14*a* and 14*b* is 8 mm. The maximum value for this distance is up to the vicinity of the base surface 16*a* of the mask frame (i.e. until the convex portions 19*a* and 19*b* contact the base surface 16*a* of the mask frame). Outside the convex portions 19*a* and 19*b* of the skirt portions 14*a* and 14*b*, the minimum length of the overlapping portion D1 with the wall portion 15 (measured in the direction of the tube axis) is 3–10 mm. When W1 is the width of the skirt portions 14*a* and 14*b,* and W2 is the width of the convex portions 19*a* and 19*b* as illustrated in FIG. 1, then W2/W1 is set to 0.3–0.75. The minimum length of the overlapping portion E1 (measured in the direction of the tube axis) between the wall portion 15 and the skirt portions 14*c* and 14*d* is about 10 mm.

The supporting member 17 includes for example four studs 20 that are attached to the inner surface of the side wall portions of the glass bulb 11 (the four side surfaces of the glass bulb 11) and four spring plates 21. On one end, the spring plates 21 have holes 21*a* that mate with the studs 20, and on the other end, the spring plates 21 are welded to the outer surfaces of the side walls of the mask frame 16.

To reduce overall doming and local doming, invar is used for the shadow mask 13 of the color cathode ray tube according to this embodiment of the present invention, because the yield point of invar is more than twice as high as the yield point of steel, and its Young's modulus is about 60% that of steel, so its good elastic properties make it almost suitable as a spring material. Therefore, a special apparatus for press-forming the shadow mask 13, as shown in FIG. 3, is necessary.

Figure 3A:
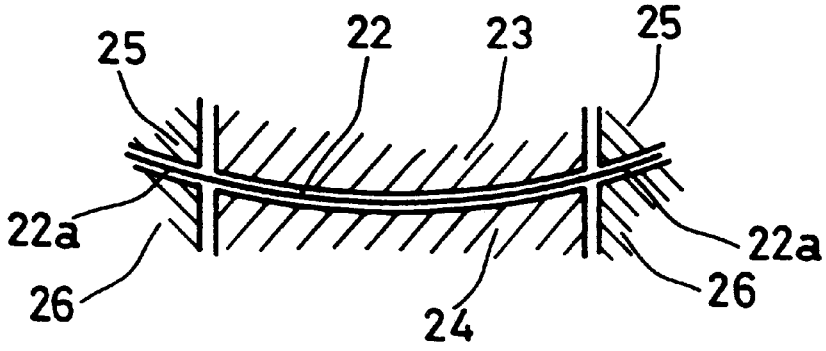
FIGS. 3(*a*) to (*c*) are cross-sections illustrating an apparatus for manufacturing the shadow mask of the color cathode ray tube in FIG. 1 and the steps for manufacturing the shadow mask.
Figure 3B:
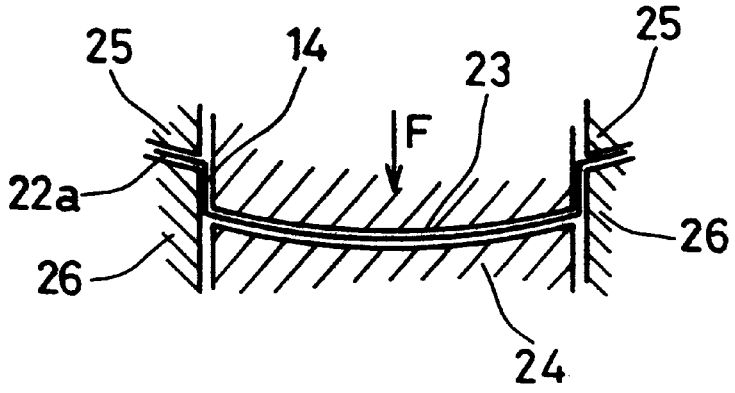
Figure 3C:
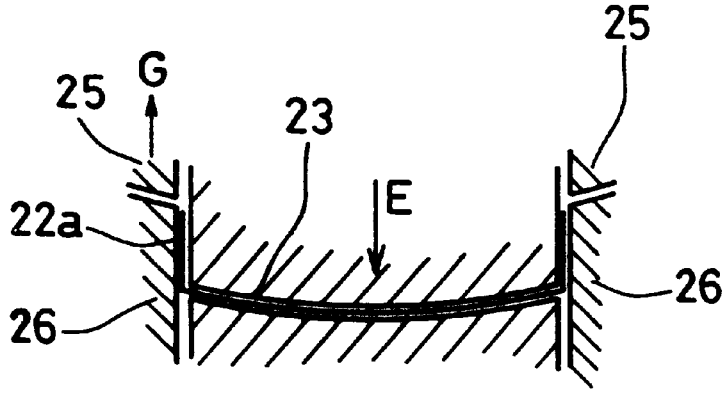
Figure 4A:
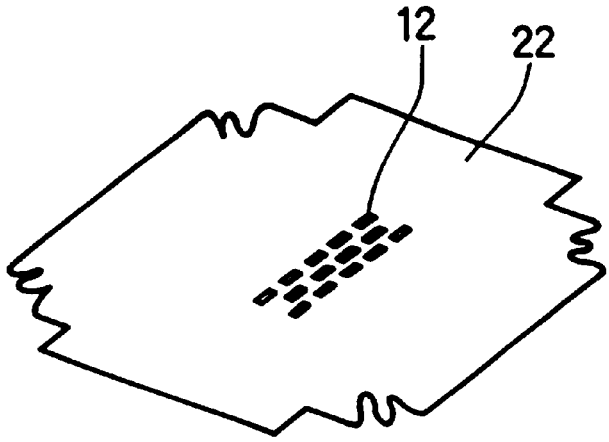
FIGS. 4(*a*) to (*c*) are perspective drawings illustrating how the shadow mask of the color cathode ray tube is formed in the manufacturing process.
Figure 4B:
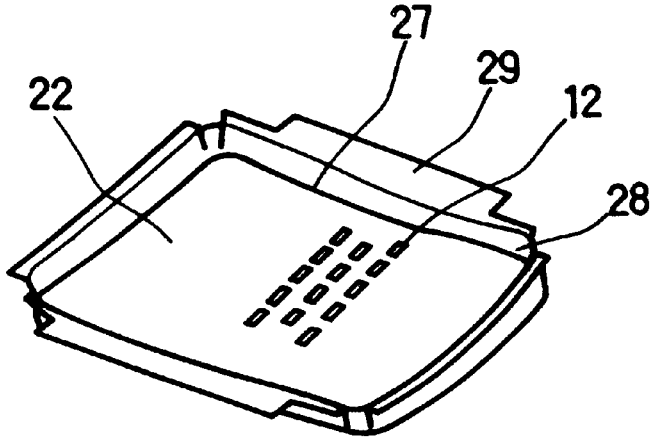
Figure 4C:
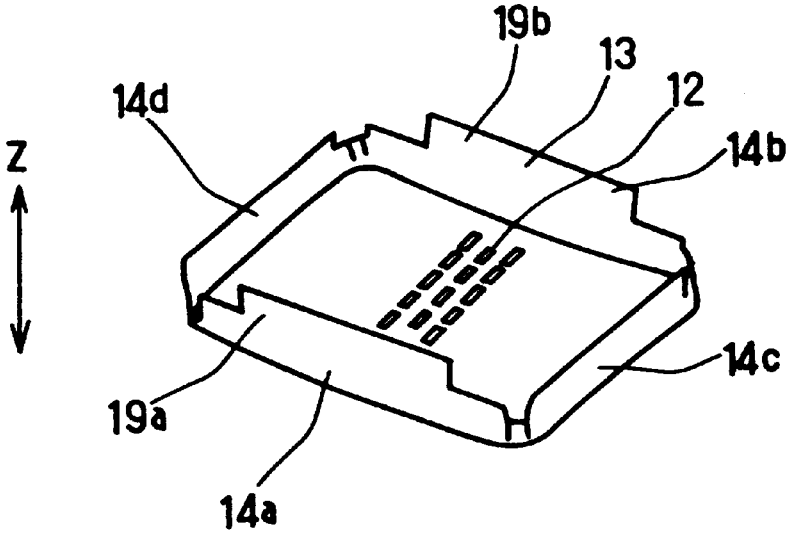

As shown in FIGS. 3 and 4, an apparatus for press-forming the shadow mask 13 used for the color cathode ray tube comprises a first upper die 23 and a first lower die 24 for forming a surface of a flat mask plate 22 having apertures 12 into a surface that is convex towards the panel 6; and a second upper die 25 and a second lower die 26 for sandwiching a peripheral portion 22*a* of the flat mask plate 22, which slidably enclose a peripheral surface of the first upper die 23 and the first lower die 24.

A method for forming the shadow mask 13 used for manufacturing the color cathode ray tube comprises placing the flat mask plate 22 of FIG. 4(*a*), which has apertures 12, on the first lower die 24 and the second lower die 26, and sandwiching it with the first upper die 23 and the second upper die 25, as shown in FIG. 3(*a*). Then, as shown in FIG. 3(*b*), the first upper die 23 and the first lower die 24, which sandwich the flat mask plate 22, are pushed downward in direction F, and the flat mask plate 22 is formed by drawing. As a result, an effective portion 27, a drawn-out portion 28 and lip portions 29 are formed, as is shown in FIG. 4(*b*). Then, only the second upper die 25 is displaced a little in direction G to release the pressure on the peripheral portion 22*a* of the flat mask plate 22 from the second upper die 25 and the second lower die 26. When the first upper die 23 and the first lower die 24 are pushed further downward in direction E, the peripheral portion 22*a* slips through the second upper die 25 and the second lower die 26, and the surface of the peripheral portion 22*a* (lip portion 29) is drawn between the first upper die 23 and the second lower die 26, as shown in FIG. 3(*c*). As a result, a shadow mask 13 is manufactured, wherein the surfaces of the skirt portions 14*a* and 14*b* that have convex portions 19*a* and 19*b* as well as the surfaces of the skirt portions 14*c* and 14*d* that do not have a convex portion are formed parallel to the direction Z of the tube axis, as shown in FIG. 4(*c*).

In this manufacturing method, since the opposite skirt portions 14*a* and 14*b* have convex portions 19*a* and 19*b* that are convex with respect to the direction Z of the tube axis, and the opposite skirt portions 14*c* and 14*d* are of short length in the direction Z of the tube axis, processing warps in the width direction of the skirt portions 14*a,* 14*b,* 14*c,* and 14*d* can be reduced. Since the lip portions 29 of the flat mask plate 22 can be used without eliminating them when manufacturing the shadow mask 13, the material for the flat mask plate 22 is used effectively.

The following is an explanation of the effects that are attained when using this color cathode ray tube.

In a color cathode ray tube embodying the present invention, the central portions of the opposing skirt portions 14*a* and 14*b* have convex portions 19*a* and 19*b* on the side facing the electron gun 9 that are more convex in the direction of the tube axis Z than the peripheral portions of the skirt portions 14*a* and 14*b,* as shown in FIGS. 1 and 2, whereby processing warps, such as wrinkles, in the width direction X of the skirt portions 14*a* and 14*b* are reduced. Even if, after the mask frame 16, to which the skirt portions 14*a,* 14*b,* 14*c,* and 14*d* of the shadow mask 13 have been welded, has been attached to the inside of the glass bulb 11, the temperature of the glass bulb is rapidly increased to about 400° C. in a frit-sealing step, and then decreased from about 400° C. to about 100° C. in an exhaustion step, deformations such as the change of processing warps in the skirt portions 14*a* and 14*b* are suppressed and the misalignment of the apertures 12 that are arranged to correspond with the color phosphors 5 on the panel 6 is reduced. As a result, the landing tolerances for the electron beam 8 become large, and color rendition is improved by reducing hits of the wrong color.

Moreover, by using invar for the shadow mask 13, overall doming and local doming can be reduced, so that the landing tolerances for the electron beam 8 are improved even more.

By making the overlapping portion C1 between the skirt portions 14*a,* 14*b* of the shadow mask 13 and the wall portion 15 of the mask frame 16 at least 8 mm, or more precisely by providing that the overlapping portion C1 is at least 8 mm and at most reaches near the base surface 16*a* of the mask frame, the magnetic resistance with respect to magnetic force lines entering in the tube axis direction Z can be reduced. As a result, displacements in the landing positions of the electron beam 8 can be reduced, and the color rendition is improved.

By setting W2/W1 to 0.3–0.75 (wherein W1 is the width of the skirt portions 14*a* and 14*b* of the shadow mask 13, and W2 is the width of the convex portions 19*a* and 19*b*), changes of the processing warps such as wrinkles in the skirt portions 14*a* and 14*b* are reduced, and the magnetic resistance with respect to magnetic force lines entering in the tube axis direction Z is decreased.

By making the convex portion of the skirt portion of the shadow mask of uniform length in the direction Z of the tube axis, wrinkles in the convex portion occurring during press-forming can be suppressed even better. If the foremost portion of the convex portions forms a straight line, the length of the central portion in the direction of the tube axis becomes the largest, so that its drawing length becomes the longest and wrinkles occur more easily.

EXAMPLE

The following is a specific example of the present invention.

A color cathode ray tube according to a first example of the present invention has the configuration shown in FIGS. 1 and 2. For this color cathode ray tube a 33-inch television tube is used, wherein the overlapping portion E1 of the skirt portions 14*c* and 14*d* of the shadow mask 13 is 10 mm, the width W1 of the skirt portions 14*a* and 14*b* is 600 mm, the overlapping portion C1 is 15 mm, and the overlapping portion D1 is 10 mm. Concerning the width W2 of the convex portions 19*a* and 19*b,* shadow masks 13 with widths W2 of 600, 450, 300, 200 and 0 mm were used.

Figure 5:
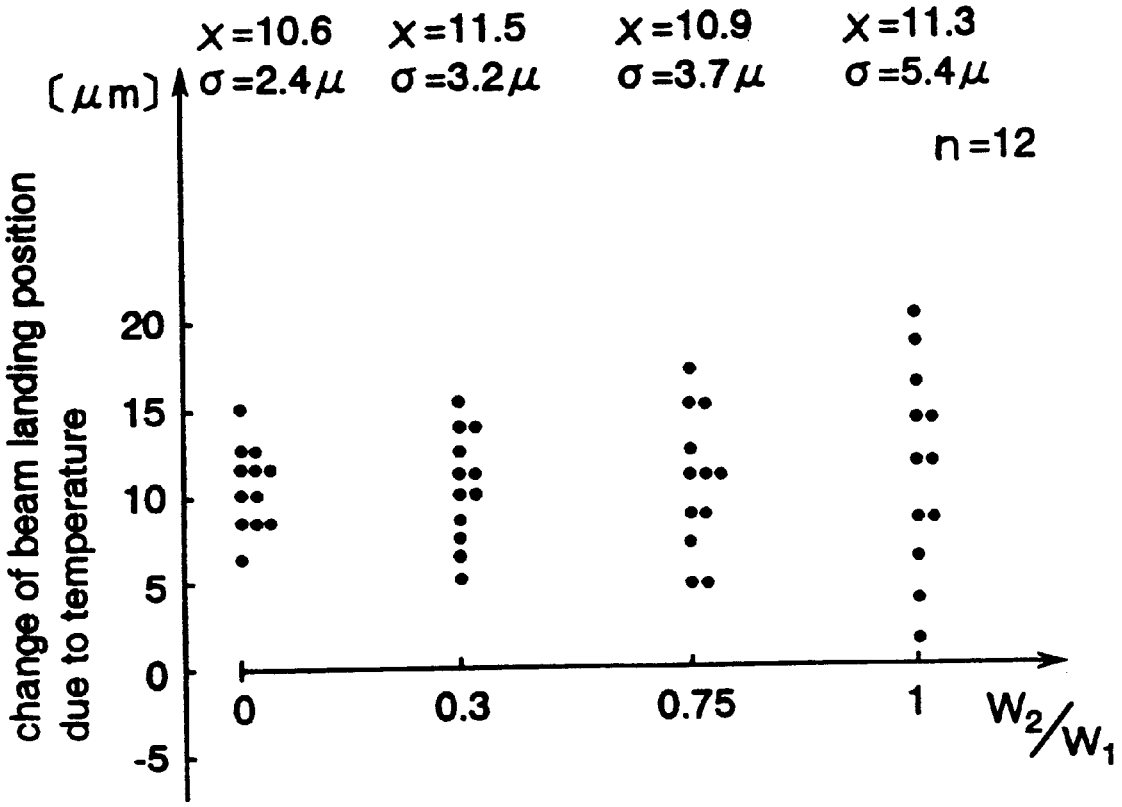
FIG. 5 is a graph showing the relation between the change of the beam landing position due to temperature and the shape of the skirt portions of the shadow mask in the color cathode ray tube of FIG. 1.
Figure 6:
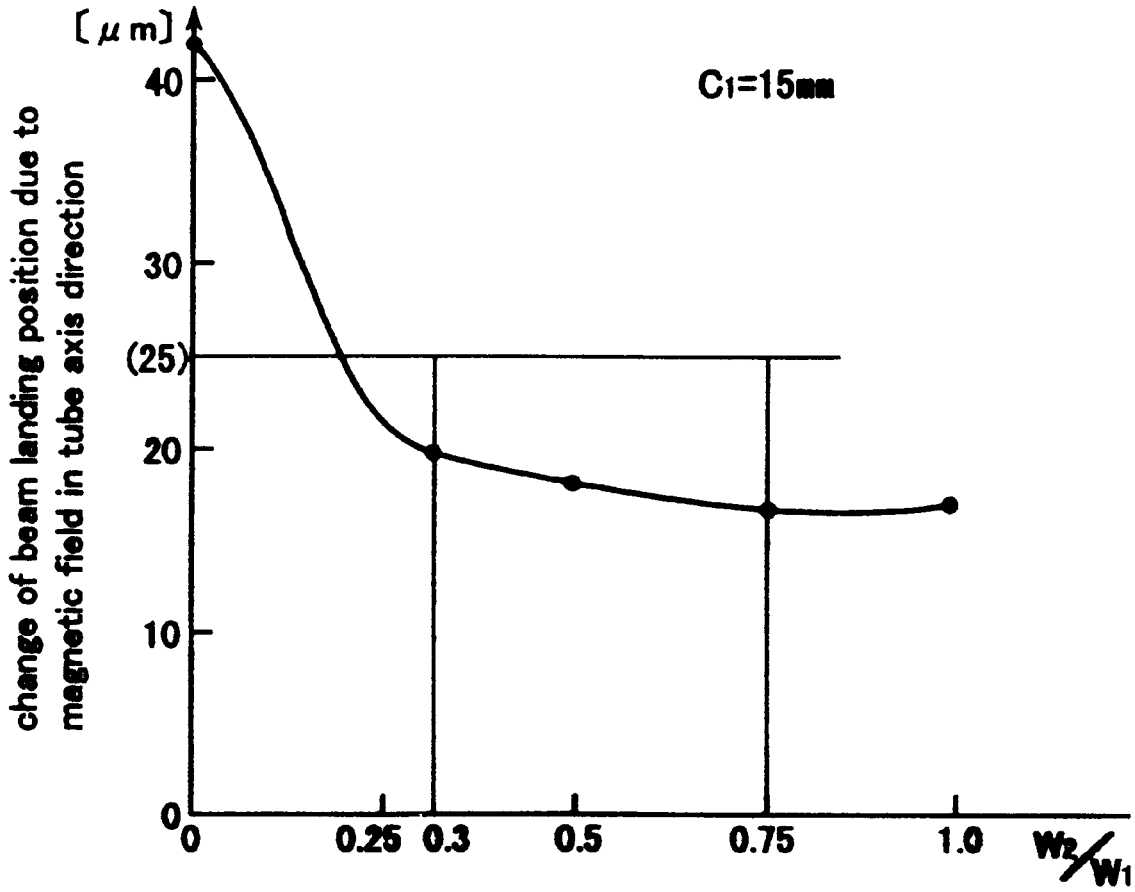
FIG. 6 is a graph showing the relation between the change of the beam landing position due to the magnetic field and the shape of the skirt portions of the shadow mask in the color cathode ray tube of FIG. 1.

When in these color cathode ray tubes the relation between the width W2 of the convex portions 19*a* and 19*b* and the change of the beam landing position due to the temperature and due to the magnetic field was examined, results as illustrated in FIGS. 5 and 6 were obtained. The change of the beam landing position due to the temperature was measured in a magnetic field-blocking chamber, by measuring the difference between the initial beam landing position for a 50 $\mu$A beam current and the beam landing position after applying a beam current of 1500 $\mu$A (which corresponds to the beam current during use of the device) for one hour (i.e., when the temperature inside the tube has reached saturation). The change of the beam landing position due to the magnetic field was measured by generating a magnetic field of 30 $\mu$H in the tube axis direction Z, and measuring the initial beam landing position of a 1500 $\mu$A beam current. In a color cathode ray tube for a regular TV, the change of the beam landing position due to the magnetic field should be not more than 25 $\mu$m to ensure correct color rendition. Furthermore, the change of the beam landing position due to the temperature or the magnetic field was measured at a point that is on a major side of the screen area and a quarter of a screen width away from the edge of the major side. Here, "major side" means one of the two longer sides in a rectangular shape.

In the first example of a color cathode ray tube according to the present invention, the change of the beam landing position due to temperature was measured with twelve samples each, as shown in FIG. 5. For W2=600 mm (W2/W1=1) the change was X=11.3 $\mu$m (average value), $\sigma$=5.4 $\mu$m (standard deviation), for W2=450 mm (W2/W1=0.75) the change was X=10.9 $\mu$m, $\sigma$=3.7 $\mu$m, for W2=200 mm (W2/W1=0.3) the change was X=11.5 $\mu$m, $\sigma$=3.2 $\mu$m, and for W2=0 (W2/W1=0) the change was X=10.6 $\mu$m, $\sigma$=2.4 $\mu$m. Thus, there was almost no change in the average value X, which is about 11 $\mu$m, but the standard deviation (variance) $\sigma$ increased as W2 became larger. Thus, it could be established that as W2 becomes smaller, the variance of the change of the beam landing position due to temperature decreases, and that from the viewpoint of mass production, a value of 450 mm (W2/W1=0.75) or lower is preferable.

The change of the beam landing position due to the magnetic field was determined with one sample each, as shown in FIG. 6. For W2=600 (W2/W1=1) the change was 17 $\mu$m, for W2=450 mm (W2/W1=0.75) the change was 17 $\mu$m, for W2=300 mm (W2/W1=0.75) the change was 18 $\mu$m, for W2=200 mm (W2/W1=0.3) the change was 20 $\mu$m, and for W2=0 (W2/W1=0) the change was 42 $\mu$m. When W2 was greater than 200 mm (W2/W1$\geqq$0.3), the change of the beam landing position due to the magnetic field did not change much and was constantly between 17 and 20 $\mu$m. Thus, it could be established that with regard to the change of the beam landing position due to the magnetic field, a W2 of at least 200 mm (W2/W1$\geqq$0.3) is preferable.

The color cathode ray tube according to a second example of the present invention differed from the first example in that the width W2 of the convex portions 19*a* and 19*b* of the shadow mask 13 was held constant at 300 mm, while the overlapping portions C1 of the skirt portions 14*a* and 14*b* were varied between 4 mm, 8 mm, 15 mm and 20 mm. When the relation between the overlapping portion C1 and the change of the beam landing position due to the magnetic field was examined, the results illustrated in FIG. 7 were obtained. The method and the position of this measurement were the same as in the first example.

Figure 7:
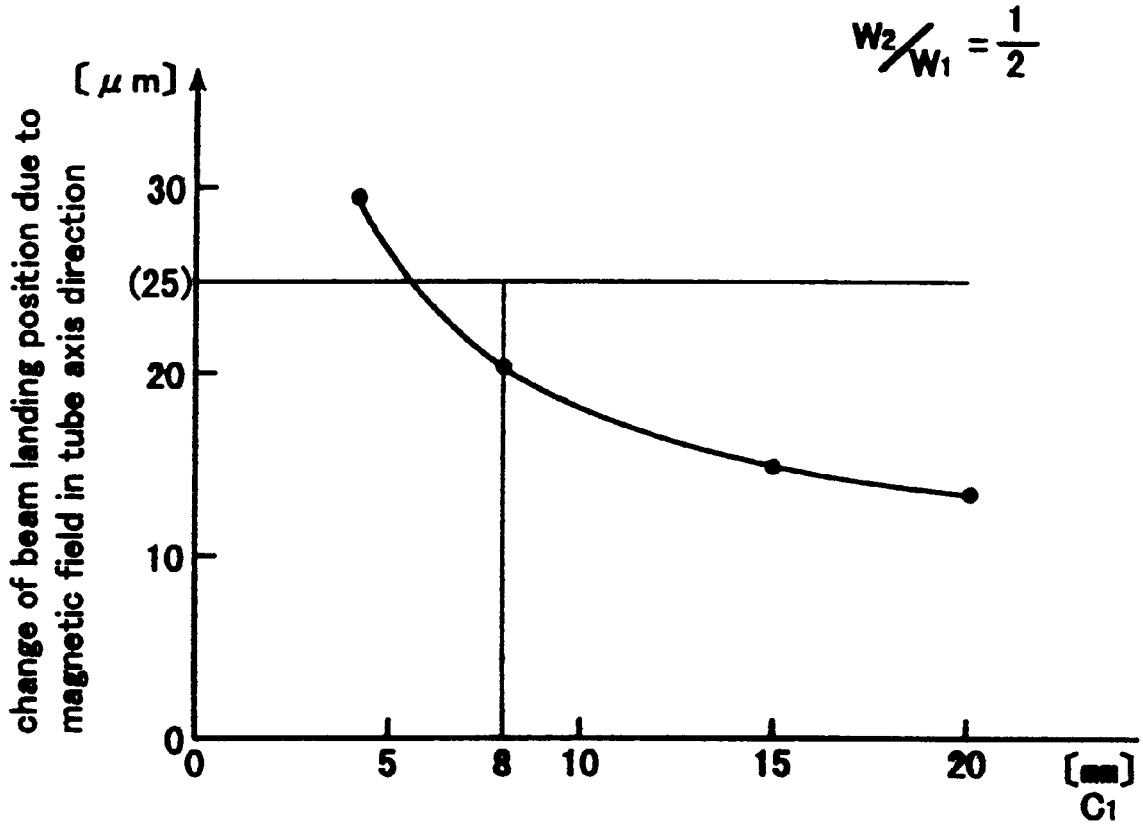
FIG. 7 is a graph showing the relation between the change of the beam landing position due to the magnetic field and the length of the skirt portions of the shadow mask in the color cathode ray tube of FIG. 1.
Figure 8:
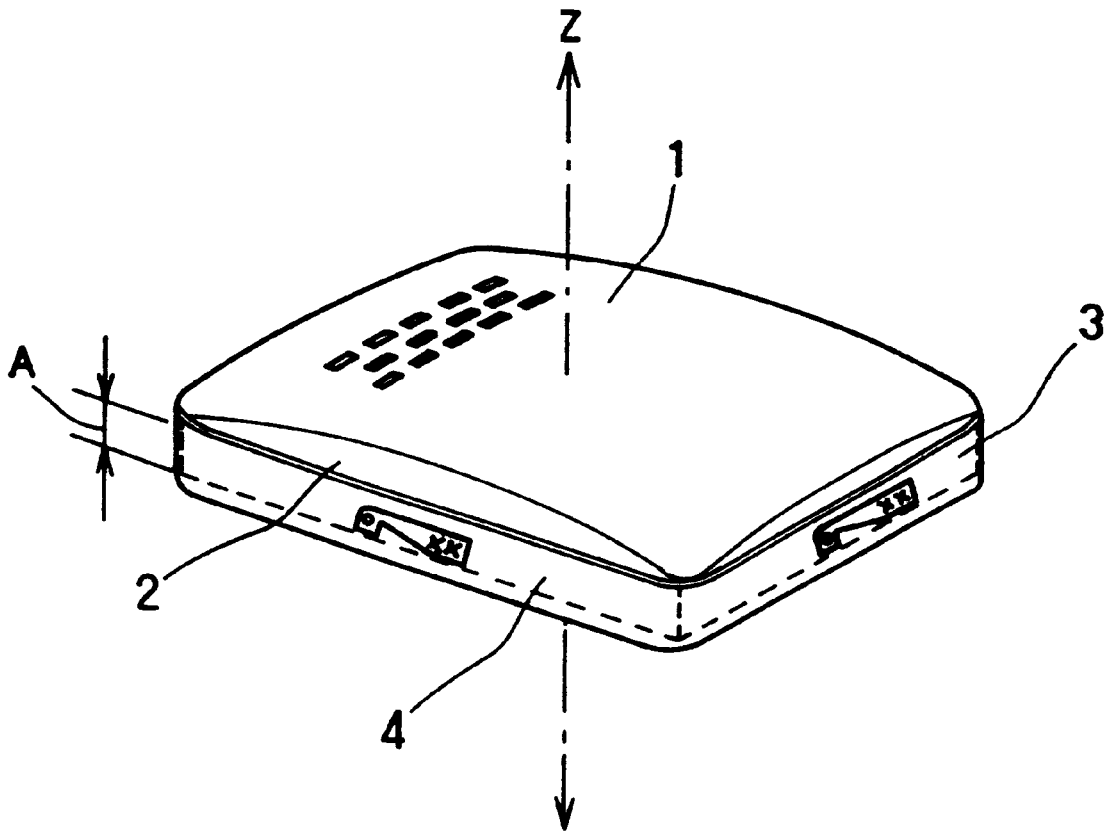
FIG. 8 PRIOR ART
FIG. 8 is a perspective view of the shadow mask portion in a conventional color cathode ray tube.
Figure 9:
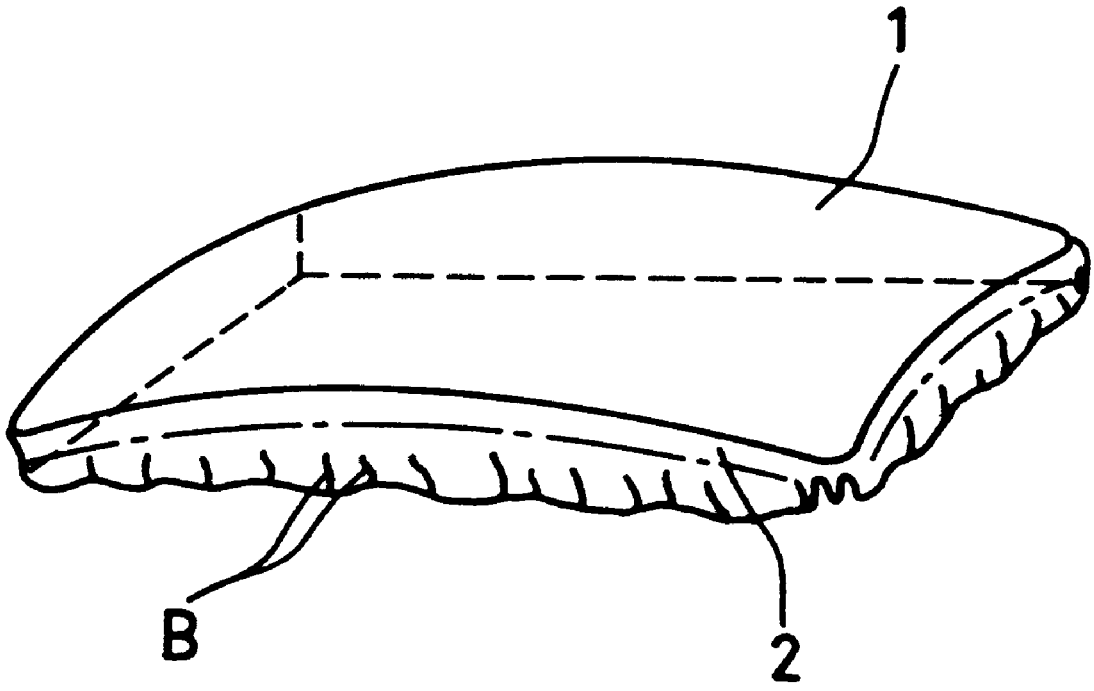
FIG. 9 PRIOR ART
FIG. 9 is a perspective view of the shadow mask in a conventional color cathode ray tube.

In this second example, the change of the beam landing position due to the magnetic field was determined with one sample each, as shown in FIG. 7. For C1 (overlapping portion of the skirt portions 14*a* and 14*b*)=4 mm, the change was 29 $\mu$m, for C1=8 mm the change was 20 $\mu$m, for C1=15 mm the change was 14 $\mu$m, and for C1=20 mm the change was 13 $\mu$m. When C1 was greater than 8 mm, the change of the beam landing position due to the magnetic field was 20 $\mu$m at most. Thus, it could be established that with regard to the change of the beam landing position due to the magnetic field, it is preferable that C1 is at least 8 mm.

By setting W2/W1 in the color cathode ray tube of the present invention to 0.3–0.75, changes in the processing warps such as wrinkles in the skirt portions 14*a* and 14*b* are reduced, and the magnetic resistance with respect to magnetic force lines entering in the tube axis direction Z is decreased. By setting C1 to at least 8 mm, the magnetic resistance with respect to magnetic force lines entering in the tube axis direction Z is decreased even further. As a result, the landing tolerances for the electron beam 8 are increased, and color rendition is improved by reducing hits of the wrong color.

In the above-noted embodiments, the shadow mask 13 was made of invar, but other materials such as steel can be used as well. Furthermore, in the above-noted embodiments, the opposing skirt portions 14*a* and 14*b* of the major sides had convex portions 19*a* and 19*b*. However, there is no limitation to this configuration, and it is also possible to provide convex portions corresponding to the convex portions 19*a* and 19*b* on the opposing skirt portions 14*c* and 14*d* of the minor sides. In order to reduce the wrinkles in the skirt portions, the convex portions 19*a* and 19*b* of the skirt portions 14*a* and 14*b* (or the skirt portions 14*c* and 14*d*) can be provided with slashes or slit holes.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A method for manufacturing a shadow mask for a color cathode ray tube having a panel and an electron gun, the method using a first upper die and a first lower die for forming a surface of a flat mask plate having apertures into a convex surface; and a second upper die and a second lower die for sandwiching a peripheral portion of the flat mask plate, which slidably enclose a peripheral surface of said first upper die and said first lower die;

the flat mask plate having convex portions, which project in an outward direction, on long sides thereof;

which method comprises:

which method comprises:

sandwiching said flat mask plate between said first and second upper dies and said first and second lower dies;

displacing said first upper die and said first lower die in a vertical direction with respect to said second upper die and said second lower die, whereby the flat mask plate is drawn and a surface of the flat mask plate having apertures is formed into a convex surface towards the panel of the color cathode ray tube;

releasing the pressure form said second upper die and said second lower die onto the peripheral portion of the flat mask plate;

forming a peripheral portion of the flat mask plate to be parallel to a tube axis direction of the color cathode ray tube by displacing said first upper and said first lower die even further with respect to said second upper die and said second lower die; and obtaining a shadow mask having skirt portions substantially parallel to the tube axis direction of the color cathode ray tube on a periphery of the surface having apertures, the skirt portions on the long sides having convex portions, which project towards the electron gun in a direction parallel to the tube axis direction, in a substantially central portion in a long side direction, ends of the skirt portions on the long sides on the panel side and ends of the convex portions on the electron gun side being curved in a convex shape towards the panel, and lengths of the skirt portions on the long sides in a direction parallel to the tube axis in a range where the convex portions are formed are substantially constant.

* * * * *